US005083552A

United States Patent [19]

Lipowitz

[11] Patent Number: 5,083,552

[45] Date of Patent: Jan. 28, 1992

[54] COMPUTER CONTROLLED MASSAGE DEVICE

[76] Inventor: Harvey Lipowitz, 50151 S. Convent La., Philadelphia, Pa. 19114

[21] Appl. No.: 533,654

[22] Filed: Jun. 5, 1990

[51] Int. Cl.[5] ..... A61H 7/00

[52] U.S. Cl. ..... 128/44; 128/24 R

[58] Field of Search ..... 364/413.01, 413.02; 128/33, 44, 24 R

[56] References Cited

U.S. PATENT DOCUMENTS 4,586,510 5/1986 Glosser et al. ..... 128/423 W

FOREIGN PATENT DOCUMENTS 1236052 9/1981 Japan .

1284248 11/1989 Japan .

*Primary Examiner*—Kyle L. Howell

*Assistant Examiner*—Scott R. Akers

*Attorney, Agent, or Firm*—Caesar, Rivise, Bernstein, Cohen & Pokotilow, Ltd.

[57] ABSTRACT

A computer controlled message device which can massage the entire body or any selected portion thereof. The massage may be generated by a standardized program or by an individualized program created by the user. The movement of the applicator is controlled simultaneously and independently in all three axes, transversely across the boy (X axis), longitudinally along the length of the body (Y axis) and vertically on the contour of the body (Z axis). The device can also detect the perimeter of the body and prevent the massage applicator from moving beyond the outer perimeter of the body. Furthermore, a manual control system is incorporated which enables the user to override and change the parameters inserted by the program or to insert an individualized massage routine.

63 Claims, 8 Drawing Sheets

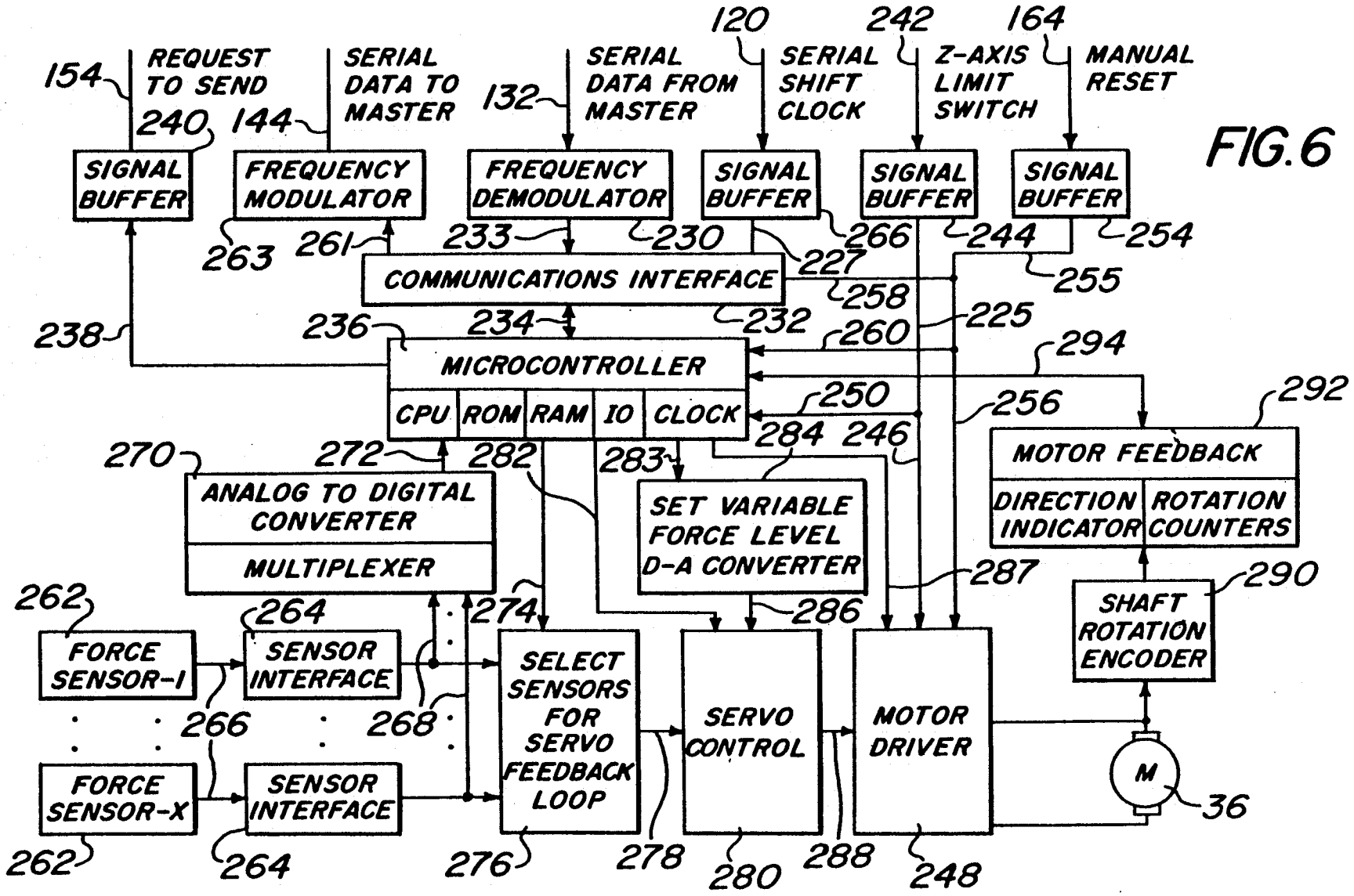
FIG. 6
MANUAL RESET
Z-AXIS LIMIT SWITCH
SERIAL SHIFT CLOCK
SERIAL DATA FROM MASTER
SERIAL DATA TO MASTER
REQUEST TO SEND
SIGNAL BUFFER
SIGNAL BUFFER
SIGNAL BUFFER
SIGNAL BUFFER
FREQUENCY DEMODULATOR
FREQUENCY MODULATOR
SIGNAL BUFFER
COMMUNICATIONS INTERFACE
MICROCONTROLLER
CPU
ROM
RAM
IO
CLOCK
MOTOR FEEDBACK
DIRECTION INDICATOR
ROTATION COUNTERS
SHAFT ROTATION ENCODER
M
MOTOR DRIVER
SET VARIABLE FORCE LEVEL D-A CONVERTER
SERVO CONTROL
SELECT SENSORS FOR SERVO FEEDBACK LOOP
ANALOG TO DIGITAL CONVERTER
MULTIPLEXER
SENSOR INTERFACE
SENSOR INTERFACE
FORCE SENSOR-1
FORCE SENSOR-X
120
132
144
154
164
225
227
230
232
233
234
236
238
240
242
244
246
250
254
255
256
258
260
261
263
264
266
268
270
272
274
276
278
280
282
283
284
286
287
288
290
292
294

COMPUTER CONTROLLED MASSAGE DEVICE

BACKGROUND OF THE INVENTION

This invention relates generally to a massage device and in particular to a computer controlled massage device.

Various massaging devices have been disclosed in the prior art. Such devices commonly utilize an applicator that moves on the body. The applicator imparts various stimuli to the body, such as vibration, heat or pressure. Certain types of existing devices have massage applicators which are supported by, or embedded into, a structure, such as a chair, table or back cushion. Some examples of such devices are described in Niessen, U.S. Pat. No. 4,513,738; Inada, U.S. Pat. No. 4,009,710; Otuka et.al., U.S. Pat. No. 4,576,149; and Roberts, U.S. Pat. No. 3,601,121. In these types of devices, the applicators are driven by an electric motor which eliminates the need for manual assistance in the massaging process. However, the movement patterns and ranges for their applicators are limited and they are usually confined to only a few specific areas of the body. They are not suitable for massaging entire regions of the body.

Teren, U.S. Pat. No. 4,412,535, teaches a remote controlled self-propelled vehicular unit which massages as it moves on the body of the user. It cannot massage near the perimeter of the body. Goodman, U.S. Pat. No. 4,386,493 discloses a unit with rollers with a control unit into which a punched card is placed to provided parameters such as starting and final position, speed of traverse and pressure.

Hand held massagers are also in general use. They can be applied to any area of the body, but they are difficult to use and tedious. Effective massaging with hand held devices requires repetitious manual movements of the applicator for extended periods of time. Furthermore, certain areas of the body cannot easily be reached by a person applying the applicator for self massage. To obtain an effective massage to cover all areas of the body, a second individual is required.

Other type of massaging devices which do not use a standard type of applicator are described in Ferguson, U. S. Pat. No. 3,672,357 and in Gerlich, U.S. Pat. No. 3,799,155. In Gerlich, a series of spherical balls is suspended from a supporting structure which is laterally reciprocated across the body. In Ferguson, a series of straps is moved across the body.

In summary, although existing devices do provide massaging to the body, they have various shortcomings. Hand held devices are tedious and not accessible to all parts of the body for self massage. The motor driven devices do not provide for a comprehensive massage that can massage all regions of the body out to, and follow, the curved perimeter of the body. Furthermore, the user does not have a variety of packaged massages and the massagers do not allow the user to customize a massage by choosing all the variables of the massage which include the paths of the applicator, the amount of time devoted to each part of the body, which parts of the body to be massaged, and the amount of pressure to be applied and where.

OBJECTS OF THE INVENTION

Accordingly, it is the general object of the instant invention to provide a computer controlled massage device which overcomes the shortcomings of present massage devices.

It is a further object of the instant invention to provide a computer controlled massage device which can massage all portions of the body.

It is still a further object of the instant invention to provide a computer controlled massage device which automatically detects the perimeter of the body being massaged and permits the massage applicator to follow the curved perimeter of the body.

It is still yet a further object of the instant invention to provide a computer controlled massage device which allows for automatic variation of applied pressure under program control.

It is another object of the instant invention to provide a computer controlled massage device which automatically controls the positioning and paths of the massage applicator by program control along three orthogonal axes, e.g., the X, Y, and Z axes, simultaneously.

It is still another object of the instant invention to provide a computer controlled massage device which offers the user standard massage routines, provided by standard program packages.

It is still yet another object of the instant invention to provide a computer controlled massage device which allows the user to individualize massage routines.

It is an additional object of the instant invention to provide a computer controlled massage device which can automatically alter the motion and pressure of the massage applicator when it is applied to certain sensitive areas of the body.

It is yet an additional object of the instant invention to provide a computer control massage device which gives the user control over the parameters involved in the massaging process.

SUMMARY OF THE INVENTION

These and other objects of the instant invention are achieved by providing a device with a computer controlled applicator which is capable of massaging the entire body of the user. The computer can control the location and path taken by the applicator, as well as the pressure applied by the applicator, automatically under program control. Furthermore, the device determines the periphery of the body and prevents the applicator from moving outside the periphery of the body.

In another aspect of the invention, a mutual control system, in addition to computer control is used. A manual control and display panel is provided which allows the user to control the position and path of the applicator, the pressure applied by he applicator, the time of the massage and the speed of the movement of the applicator. A manual reset switch is also provided, which allows the user to stop the massage and lift the applicator off the body at any time.

DESCRIPTION OF THE DRAWING

These and other objects and many of the intended advantages of this invention will be readily appreciated when the same becomes better understood by reference to the following detailed description when considered in connection with the accompanying drawing wherein:

FIG. 6 is a block diagram of the "applicator pressure control" sub-system of the system of FIG. 4;

DETAILED DESCRIPTION OF PREFERRED EMBODIMENT

Figure 1:
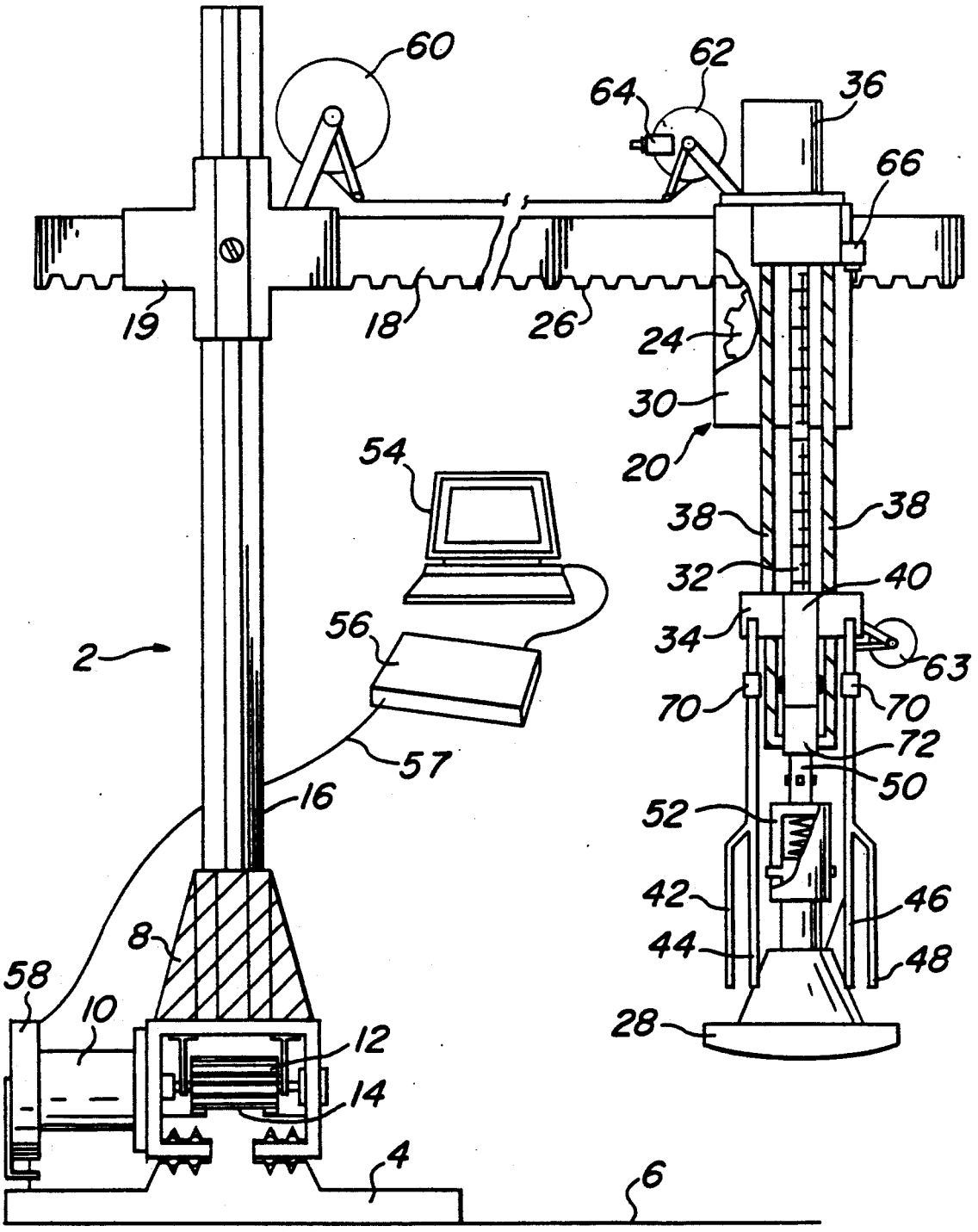
FIG. 1 is a front elevation view of the massager system of this instant invention.

Referring now in greater detail to the various figures of the drawing, wherein like reference characters refer to like parts, there is shown at 2 in FIG. 1, one exemplary embodiment of a massager system constructed in accordance with this invention. That massager system will be described in detail later. Suffice it for now to state that the system 2 comprises an applicator device (to be described later) which performs the actual massage, i.e., applies one or more stimuli to the body of the user, and is mounted on a support and connected to a computer which controls the operation of the device. The support structure of the system is placed on a platform alongside the person to be massaged and includes a cross arm which allows an applicator device to move laterally across the body of the user, and a base track which provides for movement of the applicator longitudinally along the body. The arm of the applicator also can move vertically to follow the vertical contours of the body and apply varying pressure to the body during massage.

On the sides of the applicator are edge detector sensor devices which detect the perimeter of the body and which allow the applicator to move along the perimeter of the body without moving outside the perimeter. Reversible motors are used to control the movement of the applicator in the X (lateral), Y (longitudinal) and Z (vertical or up/down) directions.

The movement and operation of the applicator device is controlled by a computer which directs the applicator in three axes orthogonal axes, e.g., X, Y, and Z, on a continuous basis by controlling the reversible motors. Thus, the paths of the applicator can be customized as desired, with the applicator moving along any axis independently of movement along the other axes. In addition, the system includes a force sensor located above the applicator to control the pressure applied by it to the body.

In addition to automatic computer control, a remote control panel is provided to enable the user to control the parameters for the movement of the applicator and the application of pressure, if desired.

Thus, as will be appreciated by those skilled in the art, the device can be tailored for use with standardized programs to massage the entire body, or portions thereof. In addition, the user can individualize the massage and create a program which can be stored for later use. The user can also interrupt a computer controlled message and insert parameters as desired.

Moreover, the computer can store data which gives the contour of the body of the user so that the parameters can be automatically changed as desired, e.g., when sensitive areas of the body, such as behind the knees, are reached by the applicator, or to apply different pressures and applicator movement paths to different parts of the body.

As can be seen clearly in FIG. 1, massage system device 2 comprises base track 4 which is arranged to be placed upon any suitable platform 6, e.g., a cart, table, etc. The person to be massaged lies on the platform 6, adjacent and parallel to the base track 4. A carriage 8 is mounted to ride along the base track 4, under the control of a reversible motor 10. The carriage serves to support a vertical arm 16 thereon. The arm in turn supports a horizontal cross arm 18. The cross arm in turn directly supports the applicator assembly 20.

The reversible motor 10 is mounted on the track 4 and is coupled, through a pinion gear 12 and cooperating rack portion 14 on the track 4, to the carriage 8. Thus, rotation of the reversible motor 10, causes pinion gear 12 to rotate. Since the pinion gear 12 meshes with rack portion 14, this action causes the carriage 8 to move along the base track 4 when the motor 10 is rotated. Moreover, since the motor 10 is reversible, the carriage 8 can move in either direction along the base track 4. This establishes longitudinal motion along the body of the person, e.g., in the "Y" direction to move applicator 28 longitudinally (from head to foot or vice versa) along the body of the person. The horizontal or cross arm 18, is, as noted earlier, supported by the vertical arm 16 of the carriage 8. In particular a bracket 19 is mounted on the vertical arm 16. The cross arm 18 is mounted on the bracket 19. A reversible motor 22 (see FIG. 2) is coupled to a pinion gear 24. The gear 24 meshes with a rack 26 forming a portion of the cross arm 18. Thus, as the reversible motor 22 is rotated, the applicator assembly 20 is moved towards or away from the vertical arm 16. This moves the applicator 28 transversly or laterally (e.g., in the "X" direction) across the body of the person being massaged.

Thus far it can be seen that the operation of the reversible motor 10 will move applicator 28 along the Y axis parallel to the base track 4, while the operation of reversible motor 22 which drives the pinion gear 24 will move the applicator 28 along the X axis, i.e. closer to or further from, the base track 4.

The movement of the applicator 28 vertically, e.g., along the Z axis, will now be described. To that end it can be seen that a carriage 30 is mounted on the cross arm 18 The carriage supports the applicator 28 for vertical movement with respect to it. Thus, the carriage 30 supports a lead screw 32, which meshes with a nut 34. A reversible motor 36 is mounted on the carriage and connected to the upper end of the lead screw 32. The lead screw 32 is arranged to be rotated by the motor 36. A pair of support rods 38 are provided to restrain the nut 34, thereby preventing it from rotating.

The applicator assembly 20 includes a stem 40 which is fixedly secured to the nut 34. As the reversible motor 36 is rotated, the applicator stem 40 is thus moved up or down (depending upon the direction of rotation of the motor 36), away from or toward the person who is being massaged while lying on the platform 6 (the Z axis).

Figure 2:
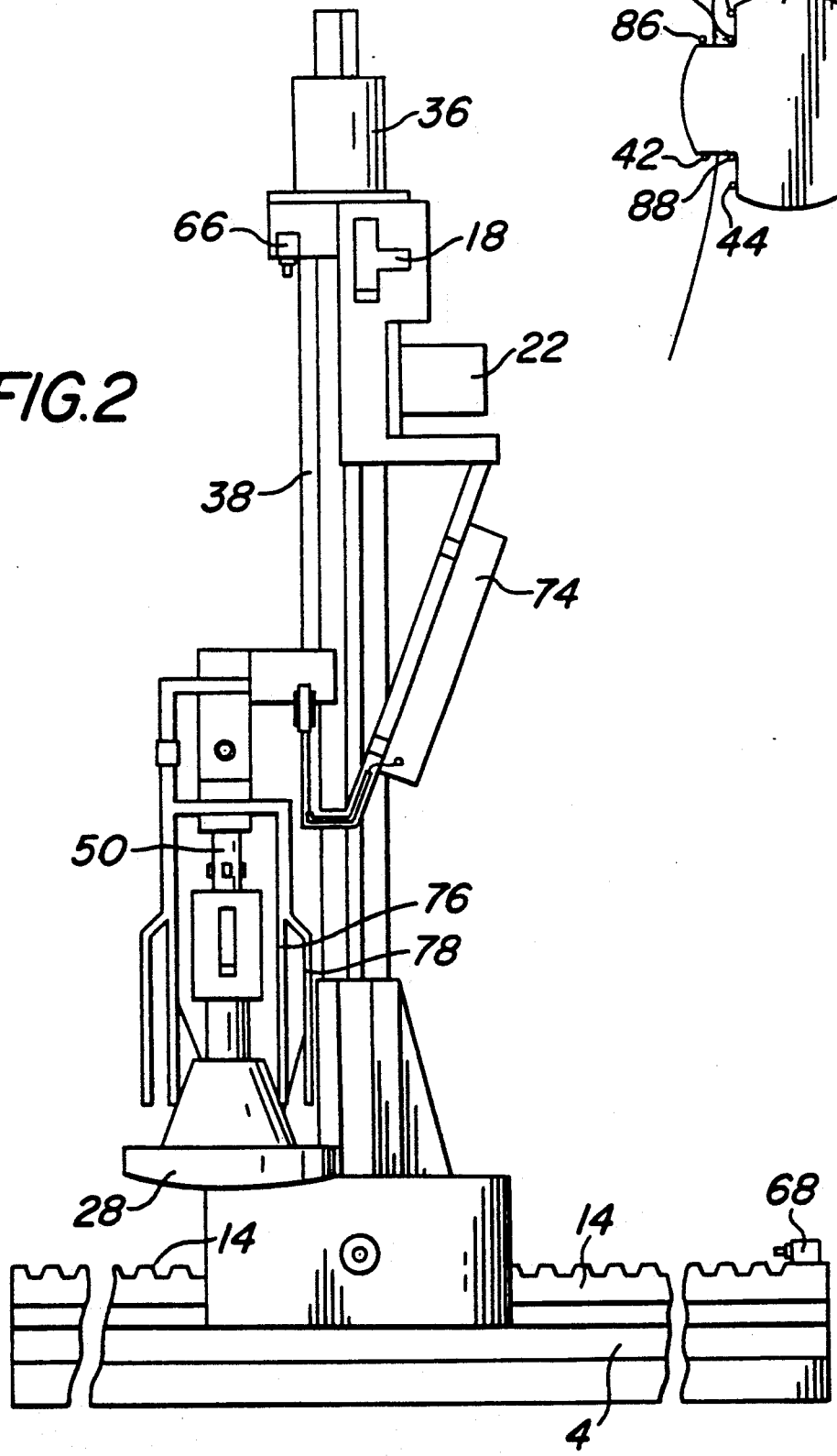
FIG. 2 is a side elevation view of the massager system shown in FIG. 1.

The applicator assembly 20 also includes twelve sensor tubes 42, 44, 46, 48, 76, 78, 80, 82, 84, 86, 88 and 90 (FIGS. 1 and 2). These are supported by the nut 34. As will be described later, each sensor tube contains an edge detection sensor which is used by the system to prevent the applicator 28 from being extended past the perimeter of the body of the user.

A load cell 50 is provided below the applicator stem 40 and above the applicator 28. This cell measures the forces resulting from the applicator's pressure and movement on the body. The force measurements provided by the cell are provided to the computer (as will be described later) to help to maintain a desired level of pressure between the applicator 28 and the body of the user.

A spring assembly 52 is also placed between the load cell 50 and the applicator 28. This assembly regulates pressure on the body while the applicator 28 is moved vertically and positioned by the lead screw 32, in response to changes in the vertical contour of the body.

Also shown in FIG. 1, the system 2 includes the heretofore mentioned computer control 54 and an interface and control panel 56. Cables 57 are connected between the control panel 56 and various motors and sensors in the system 2 to carry the signal and electrical power to the massage device's various electrical components.

Four take-up reels 58, 60, 62 and 63, are provided to prevent the cabling 57 from becoming entangled with the moving parts of the massage system.

As can be seen in FIGS. 1 and 2, three limit switches 64, 66, and 68 are mounted on the support structure so that they are engaged by moving parts thereof to stop the reversible motors 10, 22, and 36, respectively, when the carriages 8 and 30 and the nut 34, respectively, have reached the outer limits of their travel.

Detachable couplings 70 are provided to permit the interchanging of the sensor rods and detachable section 72 of the stem 40 permits the interchanging of the various types of stimuli applicators 28.

As can be seen clearly in FIG. 2, a housing 74 is mounted on the back portion of support rods 38. This housing contains additional electronic and electrical components of the system 2.

Figure 3:
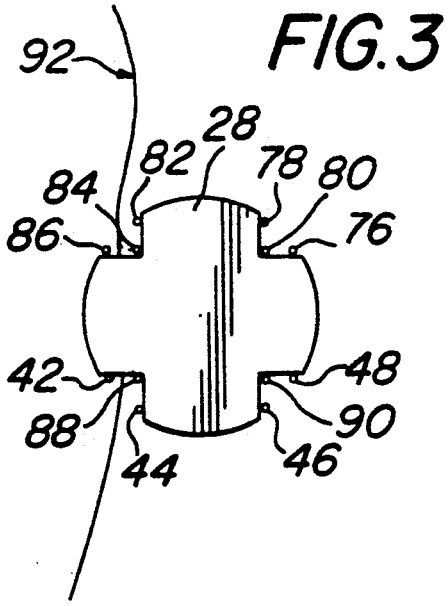
FIG. 3 is a top plan view of the massage applicator of the massager system.

The operation of the body edge detector sensors will now be described in conjunction with FIG. 3. As noted earlier, FIG. 3 shows a top plan view of the applicator 28 and the positions of the sensor tubes. Each of the twelve sensor tubes 42, 44, 46, 48, 76, 78, 80, 82, 84, 86, 88, and 90 is a hollow member holding therein a respective edge detector sensor. The operation of the body edge detection and control system will be described with relation to the body edge detectors in sensor tubes 42 and 88.

The body edge detection sensors can be pyroelectric infra-red sensors which react to a change in temperature, generating a pulsed signal when the sensors move past the edge of the body in either direction.

As the applicator 28 is moved down the side perimeter 92 of the body, the body edge detector sensor in the sensor tube 42, as it passed the edge of the body, generated a pulse, which was provided to the control components of the system 2 to move the applicator 28 to the left. The applicator 28 will continue to move to the left, until the edge detector sensor in the immediately adjacent sensor tube 88 passes over the edge of the body. At that time the edge detector sensor in the sensor tube 88 will generate a pulse and provide it to the control components which will move the body applicator to the right. Thus, the edge detector sensors in sensor tubes 42 and 88 operate in conjunction with one another to keep the applicator 28 within the width of the portion of the user's body over which the applicator is then positioned. The other edge detector sensors also operate in conjunction with one another to enable the applicator 28 to move to any position within the perimeter, or along the perimeter, of the user's body.

Figure 4:
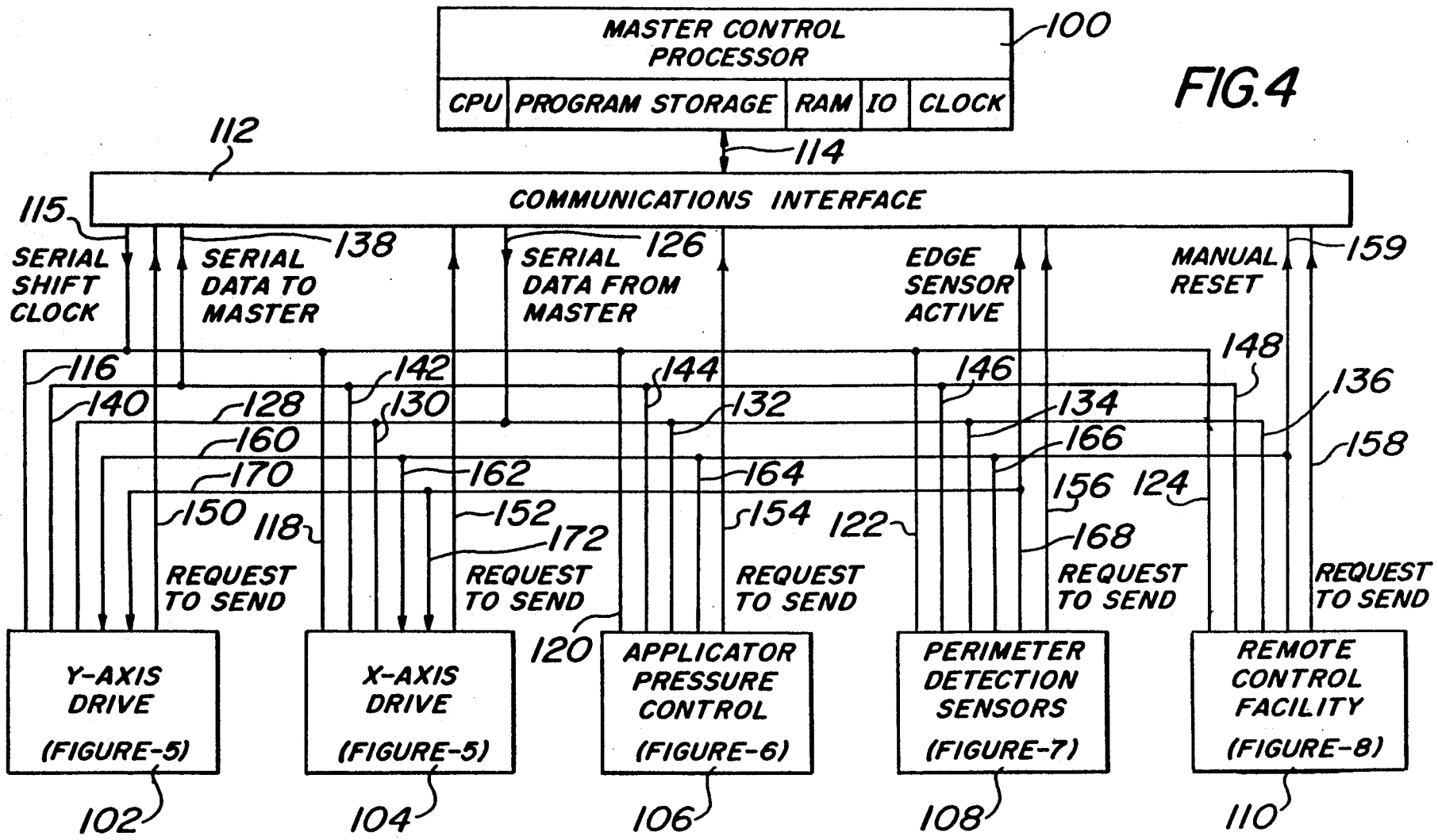
FIG. 4 is an over-all block diagram of the various components making up the electrical portion of the system.

The computer control of the massage system will now be explained with reference to the block diagrams of FIGS. 4-8. FIG. 4 is an over-all block diagram of the computer control 54. As can be seen, the computer control 54 includes a master control processor 100. The processor 100 interfaces with, and controls the operation of, the various sub-systems, i.e., the Y axis drive sub-system 102, the X axis drive sub-system 104, the applicator pressure control sub-system 106, the perimeter detection sensors sub-system 108, and the remote control facility sub-system 110.

The function of the Y axis sub-system 102 is to control the positioning, path and speed of the applicator 28 longitudinally along the body of the user.

The function of the X axis sub-system 104 is to control the positioning, path and speed of the applicator 28 transversly across the body of the user.

The function of the applicator pressure sub-system 106 is to control the pressure applied by the applicator 28 to the body of the user by controlling the vertical positioning of the applicator 28.

The function of the perimeter detection sensors sub-system 108 is to determine the perimeter of the body of the user and prevent the applicator 28 from moving outside the perimeter.

The function of the remote control facility sub-system 110 is to provide information and controls to the user for controlling the location, speed and path of the applicator 28, the pressure applied by the applicator, and the duration of the massage. In addition this sub-system includes a manual reset to immediately stop the massage and withdraw the applicator from the body.

The master control processor 100 communicates with the sub-systems 102–110 via communications interface 112 in serial fashion over line 114. The term "line" as used herein refers to either single conductors or a plurality of conductors. Serial shift clock pulses are provided from the communications interface 112 by line 115 to the various sub-systems 102-110, on lines 116, 118, 120, 122 and 124. These shift pulses control the timing of data communications between the sub-systems 102–110 and the master control processor.

Serial data from the master control processor 100 is carried by line 126 to the sub-systems 102–110, respectively, via lines 128, 130, 132, 134, and 136. Serial data back to the master control processor 100 from the sub-systems is carried to the communications interface by line 13 via lines 140, 142, 144, 146, and 148, respectively. The data then flow from the communications interface 112 over the line 114 back to the master control processor 100.

To control traffic and timing over the serial interface, each of the sub-systems must send respective "request" signals to the master control processor 100 when it wishes to communicate. These signals appear on lines 150, 152, 154, 156, and 158 from the sub-systems 102–110, respectively, to the communications interface 112. These signals then flow from the communications interface 112 over the line 114 to the master control processor 100.

The sub-systems 102–108 may be manually controlled by the remote control facility sub-system 110. This sub-system will be described later. A manual reset switch is provided to enable the user to stop the massage and lift the applicator 28 off the body of the user. Operation of the switch generates a manual reset signal from the manual control facility 110 via line 159 into the communication interface 112, and thence to the master control processor 100 via line 114.

The manual reset signal is also carried to the Y axis drive sub-system via line 160, to the X axis drive sub-system via line 162, to the applicator pressure control sub-system via line 164, and to the perimeter detection sensors sub-system via line 166.

Manual control signals are provided from the remote control facility sub-system 110 to control the sub-systems 102–108. They are provided to enable the user to control the positioning, path, and pressure applied by the applicator 28. These signals are sent to the master control processor on line 148.

As explained previously, the body edge detector sensors control the position of the applicator 28 along the X and Y axes to prevent the applicator from being moved outside the perimeter of the body of the user. Therefore, edge sensor active signals from the perimeter detection sensors sub-system 108 are carried on line 168 and are sent to the Y axis drive sub-system, via line 170, and to the X axis drive sub-systems, via line 172.

As can be seen in FIGS. 5–8 each of the sub-systems 102–110 has its own microcontroller which operates as a slave to the master control processor 100. Each microcontroller is arranged to accept and respond to serial data from the master control processor 100 only when it is specifically addressed by the master control processor 100. As explained previously, when a sub-system is ready to send data to the master control processor 100, either upon command from the master control processor 100 or otherwise, it sends a "Request To Send" signal to the master control processor 100, via the communications interface 112. After receiving acknowledgement from the master control processor 100 the slave microcontroller is given access to the shared serial data line 114.

It should be pointed out at this juncture that the system 2 may include other sub-systems to provide additional massage-related functions.

The master control processor 100 may either be a general purpose personal computer or custom processor. Depending on the specific host or master control processor 100 chosen and the specific types of microcontrollers chosen, the assignment of any given task to either the master control processor or the microcontrollers can vary.

Figure 5:
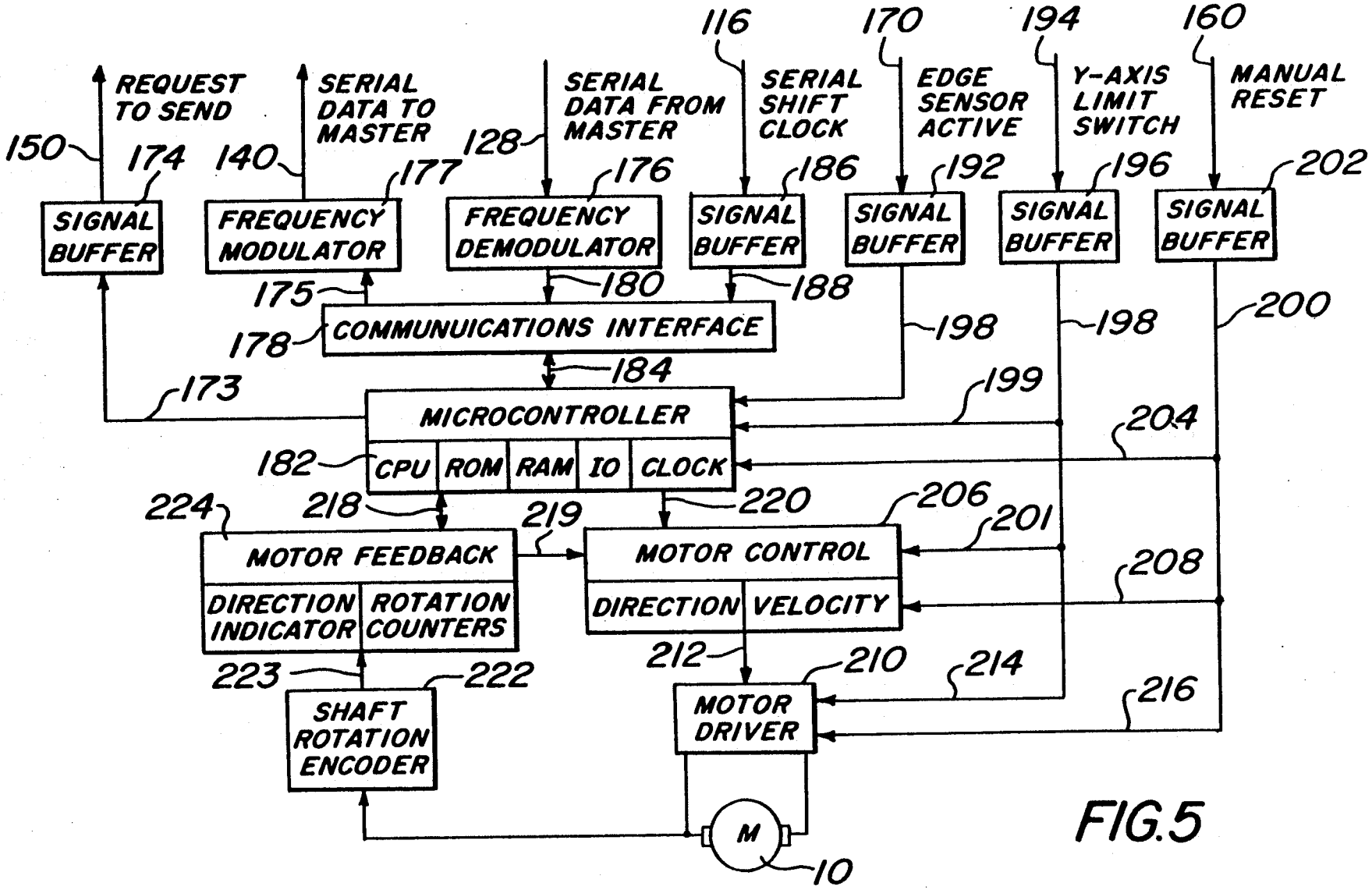
FIG. 5 is a block diagram of the "X" or "Y" axes drive control sub-system of the system of FIG. 4.

FIG. 5 is a block diagram which is representative of both the Y axis drive sub-system 102 and the X axis drive sub-system 104. The operation of the Y axis drive sub-system 102 only will be described in the interest of brevity. Thus, as can be seen that sub-system basically comprises five signal buffers 174, 186, 192, 196, and 202, a frequency demodulator 176, a frequency modulator 177, a communications interface 178, a microcontroller 182, a motor control unit 206, a motor driver unit 210, a shaft rotation encoder 222, and a motor feedback circuit 224.

As was discussed in relation to FIG. 4, serial data from the master control processor 100 is transmitted on line 128 to the Y axis drive system. The data is in the form of a frequency modulated signal. Frequency demodulator 176 receives this signal via line 128 and converts the serial frequency modulated signals into digital form. The output of the frequency demodulator 176 is connected to communications interface 178 via line 180. The output of communications interface 178 is in turn connected to slave microcontroller 182 by line 184.

The serial shift clock signal appears on line 116 as a input to signal buffer 186 where they are shaped. The function of all signal buffers used in system 2 is to shape the incoming digital information. After being properly shaped by signal buffer 186, the shift clock signal is provided to the communications interface 178, via line 188. The serial data appearing on line 128 from the master control processor 100 is only accepted by the microcontroller 182 when the microcontroller recognizes its address generated by the master control processor 100.

Signals which indicate that the body edge detector sensors are active are carried on line 170 to signal buffer 192, which provides them via line 193 to the microcontroller 182.

The operation of the Y axis limit switch 68 produces a signal on line 194. This line serves as an input to signal buffer 196. The buffer provides the shaped signal, via lines 198 and 199, to the microcontroller 182.

The manual reset signal on line 160 is provided to the signal buffer 202. The output of the signal buffer 202 appears on line 200 and is connected to the microcontroller 182, via line 204.

The output of signal buffer 196, which carries the signal from the limit switch 68, is also provided to the motor control unit 206, via line 201. The function of the motor control unit is to start, stop, control the direction of rotation, and to vary and regulate the velocity of the motor 10.

The manual reset signal appearing on line 160 is provided to signal buffer 202. The output of the signal buffer 202 is provided to the motor control unit 206, via line 208.

The output of the motor control unit 206, is connected via line 212 as an input to motor driver unit 210 Additional inputs to the motor driver unit 210 are provided by line 214 (carrying the limit switch signal) and line 216 (carrying the manual reset signal). The manual reset signal commands the motor driver unit 210 to stop the motor 10. The output of the motor driver unit 210 is connected to the carriage moving motor 10 to control its velocity and speed.

As can also been seen in FIG. 5, a feedback loop is provided for continuous and dynamic control of the motor 10 in accordance with signals received from microcontroller 182, via lines 218 and 220. Thus, as can be seen the feedback loop includes the shaft encoder 222 which is connected via line 223 to the motor feedback unit 224. The encoder 222 is mounted on the output shaft of the motor 10 and provides signals via line 223 to the motor feedback unit 224. The motor feedback unit 224 provides an input signal to the motor control unit 206, via line 219. The speed of rotation of the motor 10 is obtained by sampling the value of the signal provided by shaft rotation counters in the motor feedback unit 224. These counters store and count the signals provided by the shaft encoder and also indicate the position of the encoder 222. Direction of rotation is determined by whether the counters are up-counting or down-counting.

The microcontroller 182 receives information from the motor feedback unit 224, via line 218, and also provides information to the motor feedback unit 224, via line 218, and to the motor control unit 206, via line 220, for smooth applicator movement. Therefore, the motor control unit 206 carefully accelerates and decelerates the motor 10, avoiding abrupt applicator movements and preventing position overshoot or undershoot.

Information stored in the master control processor 100 is sent to the microcontroller 182 to control the operation of the motor 10. Velocity and destination information is sent to the microcontroller 182 which controls the motor 10 via the motor control unit 206, to move the applicator 28 to the desired destination at the desired velocity. The master control processor 100 commands can also specify velocity and time duration. If a location and time period are specified, the microcontroller will calculate the velocity and drive the motor accordingly.

In other modes of operation, the X and Y axes motor control units are synchronized to move the applicator in a predetermined pattern, such as a continuous sine wave or circle (or in any other paths defined by t master control processor 100), with respect to the user's body.

The manual reset signal at output of the signal buffer 202 is coupled, via lines 204, and 216, to the microcontroller 182, the motor control unit and the motor driver 210, to enable the user to immediate the motor 10.

It should be pointed out the control of motor 22 is effected in the same manner by X axis drive sub-system 104.

When the microcontroller 182 to send information to the master control processor 100, transmits a "Request To Send" signal, via line 173, to the si buffer 174. The signal buffer provides the signals to the control processor 100 via line 150.

The microcontroller 182 also sends serial data to the master control processor 100. This is accomplished via the communications interface 178 and frequency modulator 177. In particular the serial data from the is provided by line 184 to the communications 178. Signals representing such data are provided the interface 178, which transmits the data on line 175 to frequency modulator 177. The frequency modulator converts the pulse data into frequency modulated form. After by the frequency modulator 177 the data is via line 140, to the master control processor 100.

The applicator pressure control sub-system 16 is shown in block diagram form in FIG. 6. The sub-system 106 basically comprises four signal buffers 240, 2 244 and 254, a frequency demodulator 230, a communications in 232, a microcontroller 236, a motor driver 248, plural sensors 262, a frequency modulator 263, plural sensor 264, an analog-to-digital converter 270, a select for servo feedback loop unit 276, a servo control unit 280, variables force level digital-to-analog converter 284, a shaft rotation encoder 290 and a motor feedback unit 292. The s data from the master control processor 100 appears on line 132 to frequency demodulator 230, where it is demodulation and provided to the communications interface unit 232 in pulse form, via a line 233. Serial shift clock dating on line 120 is provided to signal buffer 226. The of the buffer 226 is provided, via line 227, to the interface 232.

The signal from Z axis lime switch 66 appearing on line 242 and which is generated when nut 34 reaches the limit of its travel, i.e., when the applicator 28 reaches the limit of its vertical travel, is provided as input to signal buffer 44. The output of signal buffer 244 on line 225 and is provided to the motor driver unit 248 line 246. This signal causes the motor drive to stop the 36. The output of buffer 244 is also provided to the 236 by line 250.

The manual reset signal on 164 which is generated when the user wishes to stop the by depressing the manual reset switch on the control pane (as will be described later), is provided as an input to si buffer 254. The output of signal buffer 254 on line 255 is to the communications interface 232, via line 258, to the interface. That signal is also provided to the motor unit 248 by line 256 and to the microcontroller 236, via 260, to stop the motor 36. As previously discussed, the signal is also sent to the X-axis drive sub-system 104 to s motor 22, and to the Y-axis drive sub-system to stop motor 1 Thus, by depressing the manual reset switch the applicator m is stopped, and the applicator is lifted from the body of user.

When the microcontroller 23 to send a message to the master control processor 100 generates a Request To Send signal on line 238 which passes signal buffer 240 for shaping. The output of signal 240 on line 154 is connected to the communications inter 112 (FIG. 4) and from there to the master control processor , via line 114.

Data to the master control processor 100 from the microcontroller 236 is provided, via 261, to the frequency modulator 263. The frequency converts the digital pulse data stream to a frequency m signal and provides an output signal on line 144 to the interface 112 (FIG. 4) and from there to the master processor 100, via line 114.

Plural force sensors 262=provided in this system. Each sensor is arranged to measure pressure applied by the applicator and to provide a signal representative thereof to an associated sensor . 264. In FIG. 6 the force sensors and associated interface shown as being from 1 to X in number to represent that any of such components may be used depending upon the application of the system 2. The plural force sensors 262 make up the identified load cell 50. The output of each sensor provided to a respective sensor interface 264, via a respect line 266. Each sensor interface serves to shape the signal to provide its output, via a respective line 268, to the converter 270. This circuit serves to convert outputs of the force sensors 262 to digital form to provide the digital signals as an input to the microcontroller 236, via line 272. The microcontroller 236 monitors these to determine which sensors to select for the servo loop and provides an output signal on line 274 to the select sensors unit 276. This unit selects the sensor chosen by microcontroller 236 and sends its output information (which i selected force sensor output in analog form), via line 278, the servo control unit 280. The servo control unit 280 on inputs from the selected force sensor 262 and the 236, to cause the motor 36 to move to adjust the force applied by the applicator equal to the level by the microcontroller.

The microcontroller 236 al sends information, via line 283, to the digital-to-analog converter 284. That converter is connected to the servo control by line 286. Thus, the signals provided thereby set the force level to be applied by the applicator 28. The servo unit 280 generates a difference signal between the from the selected force sensor and the analog input from microcontroller. The servo control unit 280 therefore an output signal to the motor driver unit 248, via line 288 i order to drive the motor 36 so that the force sensor output the computer output signal representing the required force Alternatively, the servo control unit 280 may be b with the microcontroller 236 feeding a signal directly in to motor driver unit 248 via line 287 to adjust the pressure appear by the applicator 28 to equal the pressure prescribed by the microcontroller.

A feedback loop, as to control the X and Y axes motors, is also used for motor of the applicator pressure control sub-system 106. To that end a shaft rotation encoder 290 is mounted on the shaft Z axis motor 36 and provides a signal indicative of the of the shaft of motor 36 to the motor feedback unit The motor feedback unit 292 includes direction indication circuitry and rotation counters to provide positional and direction information as received from the encoder 290 to the microcontroller 236. Thus circuit 292 is connected, via line 294, to the microcontroller 236.

The servo control unit 280 and the loop as established by the encoder 290 and motor feedback 292 ensure that smooth changes in the pressure applied by the applicator 28 is accomplished under command of the microcontroller 236.

Figure 7:
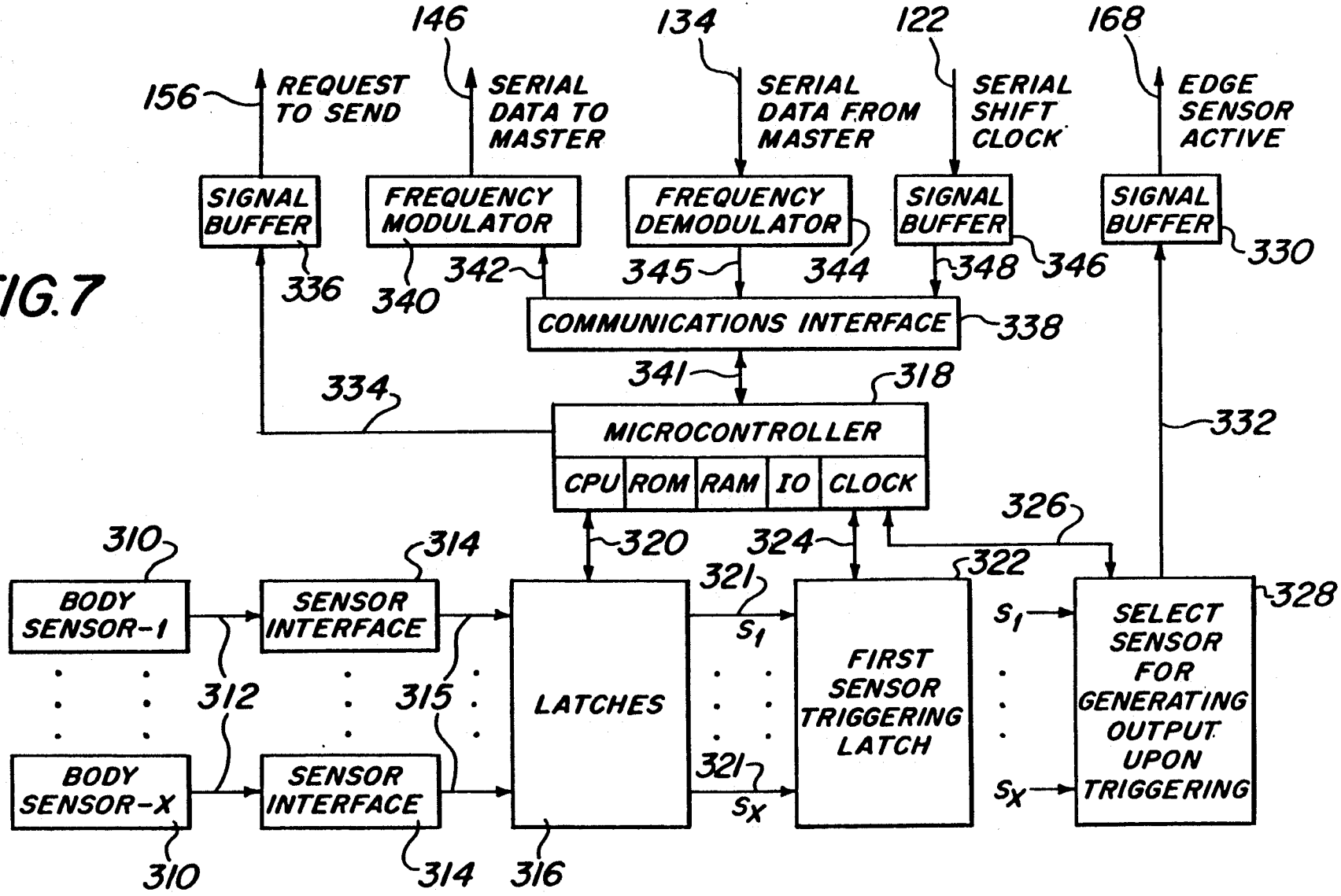
FIG. 7 is a block diagram of the "perimeter detection sensors" sub-system of the system of FIG. 4.

The perimeter detection sensors sub-system 108 will now be described with reference to FIG. 7. As can be seen therein that sub-system basically comprises plural body sensors 310, plural sensor interfaces 314, latches 316, a microcontroller 318, a first sensor triggered latch 322, a select sensor unit for generating output upon triggering 328, signal buffers 330, 336, and 346, a frequency modulator 340, a frequency demodulator 344 and a communications interface 338.

Like the force sensors 262 and associated sensor interfaces 264 of the sub-system 106, the perimeter detection sub-system 108 includes any desired number of 1 to X body sensors 310 and a corresponding number of sensor interfaces 314. Each sensor is arranged to provide a trigger pulse signal when the sensor moves outside the perimeter of the body. Each interface is arranged to amplify and shape the pulse. Thus, each body edge sensor 310 provides a signal, via a respective line 312, to a respective sensor interface 314 when it passes over the edge of the body. Because the trigger is a pulse, latching is required. The output of each sensor interface 314 is connected as an input to the latches circuit 316, via a respective line 315. The latches circuit 316 includes plural latches for storing and maintaining the outputs of the respective body sensors 312 for use by the microcontroller 318. The microcontroller 318 receives the edge sensor data, va line 320. When this occurs the microcontroller sends a clearing signal back on the line to clear the latches 316 and enable them to receive new data.

Because in some cases several body edge sensors 310 can be triggered by the time the data has been requested by the microcontroller 318, the sub-system 108 includes the first sensor triggered latch circuit 332. This latch 322 stores the information of the first body latch sensor 310 which is triggered, i.e, senses the edge of the user's body. The first sensor triggered latch 322 transmits output signals indicative of the first sensor sensing the edge of the user's body to the microcontroller 318, via line 324.

Upon command from the master control processor 100, the microcontroller 318 selects a particular sensor for generating an output, via line 326, to the select sensor unit 328. The command from the master control processor is provided from demodulator 344, via line 345. The select sensor unit 328 is arranged to transmit the trigger signal from the selected sensor when the selected sensor is triggered. Thus, the unit 328 includes plural inputs S1-SX. Each input represents a trigger signal from each of the body sensors. The output of select sensor unit 328 which is a trigger signal from the selected sensor, is provided to the signal buffer 330, via line 332. The signal buffer provides the trigger signal on line 168 to the master control processor 100 and to the microcontroller 182 of the Y and X axes drive sub-systems, 102, and 104, respectively, for directly controlling these sub-systems. Thus, the master control processor 100 does not have to continually wait for the sensors to be triggered. Instead, after a selected sensor triggers and a response by either the X or Y axis microcontroller 182 is initiated, a different sensor 310 can be selected by master control processor 100 to generate the body edge sensor active signal, and another response for the motor of the associated axis drive can be initiated by its microcontrollers 182 upon receiving that sensor signal.

When the applicator 28 has moved to the edge of the user's body, a trigger output of the selected sensor 328 causes the particular axis (X or Y) microcontroller to move the applicator in the reverse direction. The companion reference sensor 310 is then selected for triggering the output signal. When this signal appears, the direction of the particular axis' motor is again reversed, and so forth.

The microcontroller 318 is arranged to provide a Request To Send signal, via line 334, to signal buffer 336. The output of signal buffer 336 is provided on line 156, from whence it is directed to master control processor 100, via the communications interface 112 (as shown in FIG. 4).

The microcontroller 318 is also arranged to send and receive signals from communications interface 338, via line 341. Serial data representative of information the microcontroller wishes to send to the master control processor is provided from communications interface 338 to the frequency modulator 340, via line 342. The frequency modulator serves to convert the digital pulse input signal to a frequency modulated output signal and provides its output signal on line 146 to communications interface interface 112, and then to the master control processor 100, via line 114 (as also shown in FIG. 4).

Input serial data from master control processor 100 is provided, via line 134, to the frequency demodulator 344. This data represents information which the master control processor 100 wishes to send to the microcontroller 318. The frequency demodulator 344 takes this data and converts it to digital pulse form. The output of the frequency demodulator 344 is provided, via line 345, to the communications interface 338 where it is buffered, and from there to the microcontroller 318, via line 341. The microcontroller 318 uses this data as commanded by the master control processor 100.

The serial shift clock data appearing on line 122 is the shift clock of the master control processor. That data is provided to signal buffer 346. The output of buffer 346 is provided to the communications interface 338, via line 348.

The remote control facility sub-system 110 will now be described with reference to FIG. 8. That sub-system basically comprises an alpha-numeric display 350, a microcontroller 352, a user prompt audio-LED indicator unit 356, plural user input data switches 360, a user X-Y axis control unit 364, a user applicator pressure control unit 368, a manual reset switch 372, a communications interface 380, three signal buffers 384, 394, and 376, a frequency modulator 390, and a frequency demodulator 392.

Figure 9:
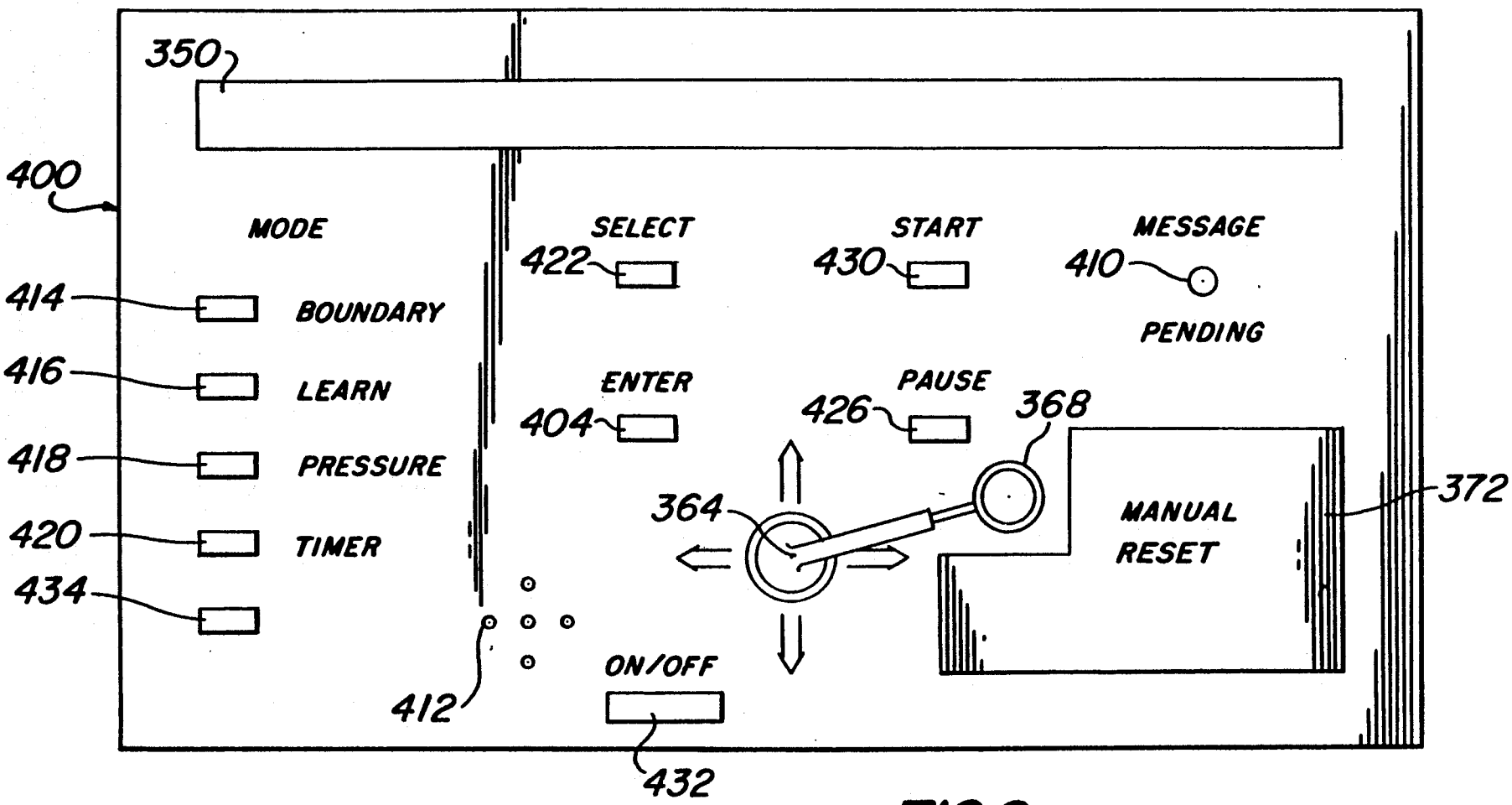
FIG. 9 is an enlarged plan view of the control panel section of the remote control facility sub-system.

The alpha-numeric display 350 is arranged to display information representing system status or user prompts asking the user to do something or provide information based on information received from the microcontroller 352, via line 354. The user prompt visual indicators 356 comprise audible (audio) and visible (LED) devices located on the control panel section 400 (FIG. 9) to advise the user pursuant to instructions from the microcontroller 352 that some input is required by the system. The indicators are activated by the microcontroller 352, via line 358. User input to the system is provided by the data switches 360. These switches and their functions will be described in detail later and are located on the control panel section (FIG. 9).

The switches are connected, via line 362, to the microcontroller 352.

The user X-Y axes control 364 provides information for manually positioning and moving the applicator 28 to the microcontroller 352, via line 366. The control 364 comprises a joy stick which is located on the control panel section 400 (FIG. 9).

The user applicator pressure control 368 comprises a plunger type of control knob which will be described later. This control allows the user to adjust the pressure applied by the applicator 28. To that end it sends information representing the amount of pressure to be applied, via line 370, to the microcontroller 352.

Also available to the user is the manual reset switch 372. This switch is also located on the control panel section 400 and will be described later. The switch is connected, via line 374, to the microcontroller 352 and also connected, via line 378, to signal buffer 376. The output of the signal buffer 376 is provided on line 159 to the master control processor and to each of the other four sub-systems 102, 104, 106 and 108, as shown in FIG. 4. The activation of the manual reset switch 372 immediately stops the axis drive motors 10 and 22, and causes the applicator 28 to be retracted away from the user's body.

The microcontroller 352 communicates with the communications interface 380, via line 382. The Request To Send signal from the microcontroller 352 is provided, via line 386, to the signal buffer 384. The output of the signal buffer 384 is provided on line 158 to the communications interface 112. The output signal from the interface 112 is provided, via line 114, to the master control processor 100 as shown in FIG. 4.

Serial data representative of information from the microcontroller 352 is provided to the master control processor 100 via line 382, to the communications interface 380 and from it, via line 388, to the frequency modulator 390. The frequency modulator is arranged to convert the digital pulse input signal to a frequency modulated signal. The output of frequency modulator 390 is provided on line 148, where it is directed to the master control processor 100.

Serial data representative of information for the microcontroller 352 from the master control processor 100 is provided, via line 136, to the frequency demodulator 392. The frequency demodulator 392 is arranged to convert the input frequency modulated signal to digital pulse form. The output of frequency demodulator 392 is provided, via line 393, to the communications interface 380, and from there, via line 382, to the microcontroller 352. Serial shift clock data representing the clock of the master control processor appearing on line 124 is provided to signal buffer 394. The shaped signal is then provided to the communications interface 380, via line 396.

The control panel section 400 of the remote control facility sub-section 110 is shown in FIG. 9. This panel section is mounted on interface and control panel 56 and serves as the means for enabling the user or someone else, e.g., a therapist, etc., to operate the system 2.

Figure 8:
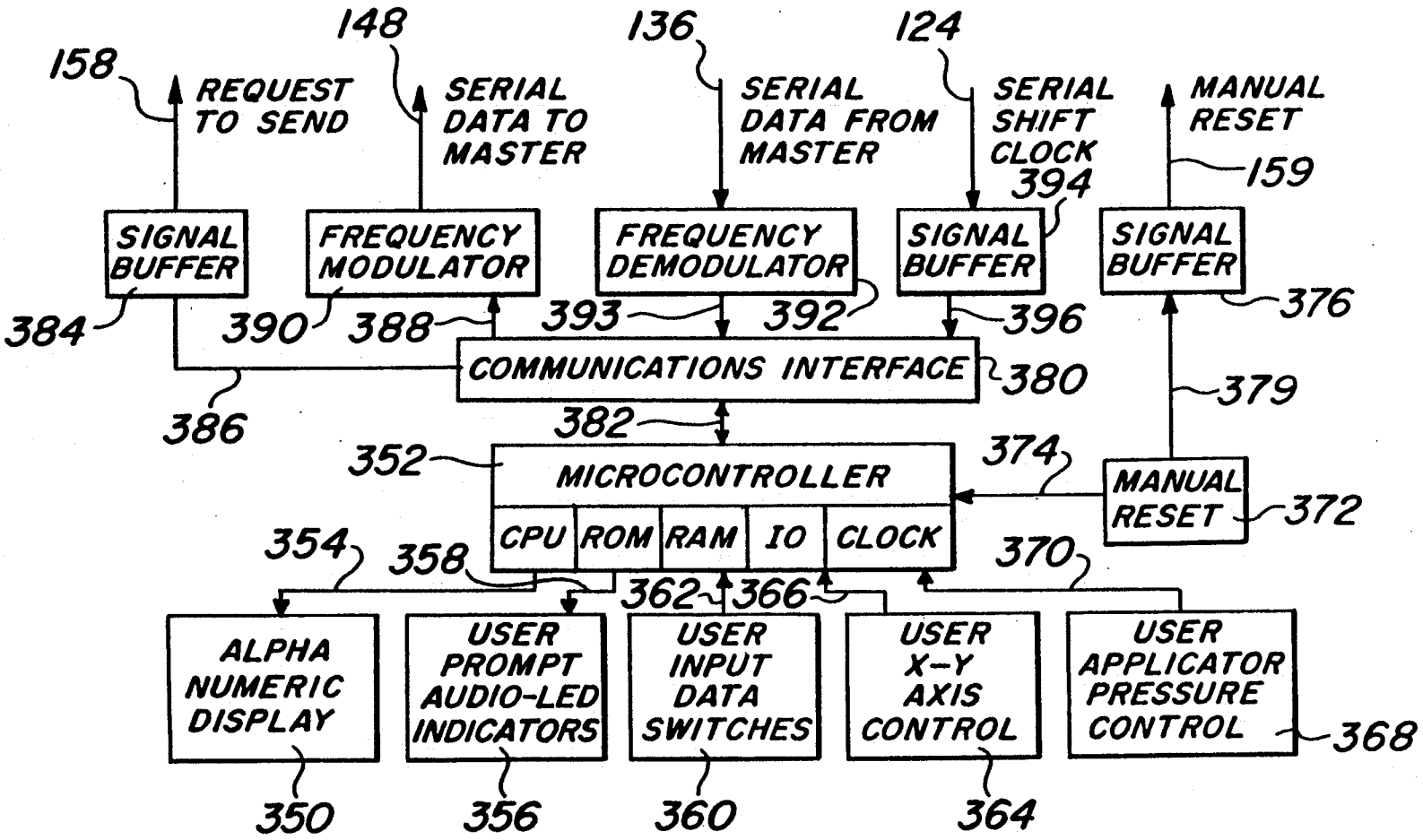
FIG. 8 is a block diagram of the "remote control facility" sub-system of the system of FIG. 4.

As can be seen the user input data switches denoted generally by the reference numeral 360 and shown in FIG. 8, are specifically designated as the mode switches 414, 416, 418, and 420, the select switch 422, the enter switch 404, the start switch 430, and the pause switch 426. All of these switches form a portion of the panel section 400. The user prompt indicators denoted generally by the reference numeral 356 and shown in FIG. 8, are specifically designated as the message pending light 410, and the audio transducer 412, of the panel section 400.

The manual reset switch 372 shown in FIG. 8 is also located on the panel section 400. The user X-Y axis control shown schematically as 364 in FIG. 8 basically comprises a "joy stick" which is mounted on the panel section 400. The applicator pressure control 368 is mounted within the joy stick.

A master power on/off switch 432 is also mounted on the panel section 400 and is connected to the system 2 to turn it on or off, as the case may be.

The remote control facility sub-system 110 serves as a communications terminal between the user and the system's master control processor 100. For example, the master control processor 100 communicates with the user by sending data to the control panel section 400. This data is displayed on the alpha-numeric display 350. The types of messages displayed thereby are those which inform the user about the condition of the systems, those that specify a manner in which the user is to interact with the system, and those which provide feedback after an action by the user.

For example, one message provided by system 2 is that the user "Prepare For a Scan" by adjusting his/her body in preparation for a system "scanning" activity that will determine the special coordinates of the body or a portion thereof. The user responds by positioning his/her body with respect to the platform 6 and then presses the "enter" switch 404.

Another message from the master control processor 100 is a request for the user to "View The PC CRT Screen" so that the user can obtain a system problem report that is too complex to be communicated through the remote control facility sub-system 110.

Another series of messages from master control processor 100 are requests to specify a particular boundary, such as the "upper boundary", "right boundary", "lower boundary" and so forth, for the applicator's path. This is accomplished by placing the applicator 28 at the desired location for the boundary using the X-Y position control joy stick 364 to position the applicator 28 at the desired location for the boundary, using the X-Y position control 364 to move the applicator 28 to the desired position, and then pressing the enter switch 404 to record the coordinates of the applicator in the system 2 for later use.

Still another message from the master control processor is a request for the user to "Specify A Pressure Control Level" to establish the desired pressure level to be applied by the applicator on the user's body during the massage. Pressure levels are set up by varying the pressure control 368 position within the frame of the X-Y axis control joy stick 364.

The relative intensity of the pressure is shown on the alpha-numeric display 350 in the form of a bar graph, whose length changes in proportion to the movement of the pressure control 368. Thus, when the user sees the desired pressure level on the display, the user depresses the enter switch 404. This causes the master control processor 100 to send a command to the applicator pressure control sub-system 106 to cause the applicator 28 to actually press onto the body with an intensity set by the user. This pressure level will be duplicated during the massage.

Also, when a message initiated by the master control processor 100 is shown on the remote control facility display 350, the user is alerted by activation of the message pending light 410 and a tone from the audio transducer 412.

The user can communicate with the master control processor 100 by pressing one of the mode selection switches "Boundary" 414, "Learn" 416, "Pressure" 418 and "Timer" 420.

Depressing the boundary switch 414 causes the applicator 28 to respond to the position of control 364 and places the message "Enter Location For The Upper Boundary" on the display. Messages specifying the right boundary, lower boundary and so forth are sequenced onto the display in order as the user sequentially presses the select switch 422.

When the user depresses the "learn" switch 416 the applicator 28 is switched over to respond to the position control as established by the position control 364 and the pressure as established by the pressure control 368. A series of command messages are displayed on the alpha-numeric display 350. The command messages are sequenced onto the display as the user presses the select switch 422. For example, one command "learn pressure and movement" signals the master control processor to begin recording the movements and pressure generated by the position control joy stick 364 and the pressure control 368. Another learn mode command "learn movement without pressure" will cause only the applicator 28 movements generated by the positioning control joy stick 364, with the pressure remaining fixed at a previously set level. Pressing the "pause" switch 426 permits the user to momentarily hold the movement of the applicator 28 without recording the inactive time period. Another command "unlearn" allows the user to delete the most recent portion of the massage being generated at that time and causes the applicator 28 to back track in accordance with the X-Y axis control joy stick 364 and the pressure control 368. Still another learn mode command "repeat message" will begin reproduction of the user orchestrated message.

When the user depresses the "pressure mode" switch 418 the user is permitted to choose the pressure that will be utilized during the message. As described previously, pressure levels are entered into the system by moving the pressure control 368 within the frame of the X-Y axis control 364. The intensity level is illustrated on the display 350 in the form of a bar graph whose length changes in proportion to the movement of the pressure control. The command messages "set pressure level from graph" and "set pressure level from applicator" are available to the user in this mode and are sequenced by pressing the select switch 422. They are chosen (entered into the system) by pressing the enter switch. Utilizing the "set pressure level from graph" command, will cause the system to apply the amount of pressure as depicted by the length of the bar graph during the massage. Selecting the "set pressure level from applicator" command causes the applicator 28 to actually press onto the body with the intensity that varies in response to the adjustment of the pressure control 368. When the enter switch 404 is depressed the established pressure level is duplicated during the massage.

When the "timer" switch 420 is depressed the user is enabled to specify a time duration for the massage. At the conclusion of the time selected, the system 2 automatically shuts itself off.

The mode commands chosen with the select switch 422 are "specify time interval", "activate massage timer" and "remove massage timer". When the "specify time interval" command is chosen, depressing the select switch 422 starts incrementing the zero digits shown on the display 350. Pressing the enter switch 404 causes the time period to count down. Pressing the timer switch 420 when the desired value is displayed sets the time interval for the massage.

Depression of the start switch 430 causes the applicator 28 to start its massaging routine as learned during its learning mode. The pause switch 426 stops the applicator 28 from moving until the start switch 430 is pressed again. While the applicator is paused, the user can amend a massage being generated from a stored program by initiating the "Learn" or "Pressure" modes and utilizing the applicator 28 positioning and pressure controls 364 and 368. When the applicator returns to the location of the body where the pause switch was pressed, the amended pressures and movements are incorporated.

Pressing the manual reset switch 372 causes the applicator 28 to immediately stop and withdraw from the body and the system to reset.

The mode switch 434 is incorporated for future software upgrades, while the on/off switch 432 applies power to the system.

Although specific modes of operation of the control panel section have been described above, it should be kept in mind that the system 2 is inherently flexible and that many other modes of operation and displays can be added or altered, as desired, to give the user flexibility in using and controlling the applicator.

As can be seen from the foregoing, the system is extremely flexible. The user may obtain a complete massage as defined by a standardized computer program, an individualized massage may be created by the user off-line, or the user can create a massage routine on-line, as desired. For example, assume that the user had a backache in the lumbar region and wished to massage that region. By depressing the learn switch 416 and using the select switch 422 for the "learn pressure and movement" command, the applicator 28 may be moved to the part of the body to be massaged using the X-Y axes control joy stick 364 and the pressure control 368 may be adjusted for the desired pressure. The user then moves the applicator as desired over the selected area. Using the timer switch 420, the time duration for the massage is specified employing the specified time interval command. Finally, by using the repeat message command, the device massages the user over the selected area by reiterating the movement of the applicator as defined by the user for the period of time specified by the user.

Also, in addition to the ability of the user to define and insert individualized massage routines, the user can interrupt any on-going massage and change the parameters of the massage (applicator location, path, pressure and time of massage) at will.

The electronic and electrical systems of this invention can easily be assembled by one skilled in the art using standard, commercially available components. An exemplary listing of components is given below. One skilled in the art can substitute other standard components for the ones listed as desired to perform the functions described in this specification.

Exemplary Listing of Standard Components

| Ref. # | Function | Type | Manufacturer |
|---|---|---|---|
| | FIG. 4 | | |
| 100 | Master Control Processor | Per. Computer-AT | IBM |
| 112 | Communications Interface | Board in IO slot of PC | |
| | Bus Buffers | | |
| | Address Buffers | 74LS367 | Fairchild |
| | Data Buffer | 74LS244 | Fairchild |
| " | PC IO slot decode | | |
| | | 74LS00 | Fairchild |
| | | 74LS04 | Fairchild |
| | | 74LS30 | Fairchild |
| | | 74LS32 | Fairchild |
| | UART | IM6402A | Intersil |
| " | Manual Reset Line | | |
| | Line Receiver Buffer | AM26LS32AC | TI |
| | Data Latches | 74LS279 | Fairchild |
| | Data Latch Tristate Buffer | 74LS125 | Fairchild |
| " | Serial Data Demodulator | XR-2211 | Exar |
| | Serial Data Modulator | XR-2206 | Exar |
| | Serial Shift Clock | IM4712 | Intersil |
| | Line Transmit Buffer | AM26LS31AC | TI |
| | FIG. 5 | | |
| 174) 186) 192)- 196) 202) | Signal Buffer Output | AM26LS31C | TI |
| | Signal Buffer Input | AM26LS32C | TI |
| 178 | Communications Interface | IM6402A | Intersil |
| 182 | Microcontroller | 87C51FA | Intel |
| | Internal Functions: | | |
| 224 | Direction Indicator | | |
| 224 | Rotation Counters | | |
| 206 | Motor Direction | | |
| 206 | Motor Velocity | | |
| 210 | Motor Driver (H-Bridge) | IRFZ22 (Quan. 4) | Internation. Rectifier |
| 177 | Frequency Modulator | XR-2206 | EXAR |
| 176 | Frequency Demodulator | XR-2211 | EXAR |
| 222 | Shaft Rotation Encoder | HEDS-6000 | Hewlett Packard |
| | FIG. 6 | | |
| 240) 226)- 244) 254) | Signal Buffer Output | AM26LS31C | TI |
| | Signal Buffer Input | AM26LS32C | TI |
| 232 | Communications Interface | IM6402A | Intersil |
| 236 | Microcontroller | 87C51FA | Intel |
| | Internal Functions: | | |
| 292 | Direction Indicator | | |
| 292 | Rotation Counters | | |
| 263 | Frequency Modulator | XR-2206 | EXAR |
| 230 | Frequency Demodulator | XR-2211 | EXAR |
| 290 | Shaft Rotation Encoder | HEDS-5000 | Hewlett Pkrd |
| 270 | Analog to Digital Converter | AD7828 | Analog Dev. |
| 284 | Digital to Analog Converter | DAC1000 | Analog Dev. |
| 280 | Servo Motor Control | MC33030 | Motorola |
| 248 | Motor Driver (H-Bridge) | 2N6488 (Quan. 2) | RCA |
| | " | 2N6491 (Quan. 2) | RCA |
| 262 | Force Sensor 1 | HBMO.6/120Y11 (2) | Omega |
| | Force Sensor 2 | HBMO.6/120Y21 (2) | Omega |
| | (Alternate types on adjacent facets of rectangular shaped load cell and alternate types arranged in adjacent legs of wheatstone bridge to negate torque and shearing force components) | | |
| 264 | Sensor Interface (Amplfier) | LH0038C | National |
| 276 | Select Sensor for Servo Feedback Loop (Analog Mux) | ADG528A | Analog Devices |
| | FIG. 7 | | |
| 336) | Signal Buffer Output | AM26LS31C | TI |
| 346)- 330) | Signal Buffer Input | AM26LS32C | TI |
| 338 | Communications Interface | IM6402A | Intersil |
| 318 | Microcontroller | 87C51FA | Intel |
| | Internal Functions | | |
| 316 | Latches | | |
| 322 | First Sensor Triggered | | |
| 328 | Select Sensor for Generating Output | | |
| 340 | Frequency Modulator | XR-2206 | EXAR |
| 344 | Frequency Demodulator | XR-2211 | EXAR |
| 310 | Body Sensors | KYNAR Piezo Film | Pennwalt |
| 314 | Sensor Interface | LM324 | National |
| | FIG. 8 | | |
| 384) | Signal Buffer Output | AM26LS31C | TI |
| 394)- 376) | Signal Buffer Input | AM26LS32C | TI |
| 380 | Communications Interface | IM6402A | Intersil |
| 352 | Microcontroller | 87C51FA | Intel |
| 390 | Frequency Modulator | XR-2206 | EXAR |
| 392 | Frequency Demodulator | XR-2211 | EXAR |
| 350 | Alpha Numeric Display | 1861 | AND |

Without further elaboration, the foregoing will so fully illustrate my invention that others may, by applying current or future knowledge, readily adapt the same for use under the varying conditions of service.

What is claimed is:

1. A device to massage the body of a person, said device comprising:
   (a) a support means;
   (b) applicator means supported by said support means for movement with respect thereto to engage said body or a portion thereof, to apply at least one predetermined massage stimuli to said body or a portion thereof;
   (c) control means coupled to said applicator means for automatically controlling the location and movement of said applicator means; and
   (d) first means for automatically determining the perimeter of said body or a portion thereof, and for providing a signal to said control means in response thereto.

2. The device of claim 1 wherein said first means comprises a plurality of edge detection sensors.

3. The device of claim 2 wherein each of said plurality of edge detection sensors is mounted in a respective one of a plurality sensor tubes, said sensor tubes being mounted on said support means for movement with said applicator means.

4. The device of claim 3 wherein each of said edge detection sensors produces a respective trigger signal for use by said computer means when said sensor is located outside the perimeter of said body or a portion thereof, thereby enabling said computer means to determine the perimeter of said body.

5. The device of claim 1 wherein said device comprises second means for preventing the movement of said applicator means beyond the perimeter of said body or a portion thereof.

6. The device of claim 5 wherein said second means is responsive to said first means.

7. The device of claim 6 wherein said one predetermined stimuli comprises pressure, and said device additionally comprises pressure control means for automatically controlling the pressure applied to said body or a portion thereof, by said applicator means.

8. The device of claim 7 wherein said device additionally comprises manual means for controlling the location and movement of said applicator means and the pressure applied to said body or a portion thereof, by said applicator means.

9. The device of claim 6 wherein said second means comprises a plurality of edge detection sensors.

10. The device of claim 9 wherein each of said plurality of edge detection sensors is mounted in a respective plurality of sensor tubes, said sensor tubes being mounted on said support means for movement with said applicator means.

11. The device of claim 5 wherein said first means comprises the same plurality of edge detection sensors and sensor tubes as said second means.

12. The device of claim 6 wherein each of said edge detection sensors produces a respective trigger signal for use by said computer means when said sensor is located outside the perimeter of said body or a portion thereof, thereby enabling said computer means to determine the perimeter of said body.

13. The device of claim 7 wherein said device additionally comprises a first reversible motor for moving said applicator means in a transverse direction across said portion of said body and a second reversible motor for moving said applicator means in a longitudinal direction along said portion of said body, said first and said second reversible motors being responsive to and controlled by said computer means.

14. The device of claim 8 wherein said computer means comprises a master control processor and a slave microcontroller controlled by, and responsive to, said master control processor, and wherein said device additionally comprises a sensor selection means responsive to said microcontroller, for selecting an edge detection sensor adjacent the sensor producing said trigger signal, whereupon when said selected sensor triggers and sends a second signal to said computer means when it is positioned outside the perimeter of said body, said computer means causes said first or said second reversible motors to move said applicator means away from said perimeter of said body or a portion thereof, until said second signal is no longer present.

15. The device of claim 1 wherein said one predetermined stimuli comprises pressure, and wherein said device additionally comprises pressure control means for automatically controlling the pressure applied to said body or a portion thereof, by said applicator means.

16. The device of claim 15 wherein said control means comprises computer means and wherein said pressure control means comprises a reversible motor responsive to, and controlled by said control means and coupled to said support means, whereupon when said reversible motor rotates in a first direction said applicator means moves towards said body or a portion thereof, increasing the pressure applied by said applicator means thereto and when said reversible motor rotates in a direction opposite to said first direction said applicator means moves away from said body or a portion thereof, decreasing the pressure applied by said applicator means thereof.

17. The device of claim 1 wherein said reversible motor comprises a shaft and wherein said pressure control means additionally comprises force detector means for measuring the pressure applied by said applicator means to said body or a portion thereof and generating signals representative thereof, and an encoder, mounted on said shaft, for generating an encoder signal representing the position of the said shaft of said reversible motor and for providing said signal to said computer means.

18. The device of claim 17 wherein said pressure control means additionally comprises motor control means, said computer means providing a pressure command signal to said motor control means indicating the amount of pressure to be applied by said applicator means to said body or a portion thereof, said motor control means comparing said pressure command signal to said force detector signals and to said encoder signal for varying the speed of rotation of, direction of, and location of the shaft of said reversible motor to increase or decrease the pressure applied to said body or a portion thereof, by said applicator means to equal the pressure represented by said pressure command signal.

19. The device of claim 17 wherein said pressure control means additionally comprises motor control means and servo control means, said computer means providing a pressure command signal to said servo control means indicating the amount of pressure to be applied by said applicator means to said body or a portion thereof, said servo control means comparing said pressure command signal to said force detector signal and sending a signal to said motor control unit to vary the speed of rotation of, direction of, and location of the shaft of said reversible motor to increase or decrease the pressure applied to said body or a portion thereof, by said applicator means to equal the pressure represented by said pressure command signal.

20. The device of claim 15 wherein said control means comprises computer means, and wherein said device additionally comprises manual means for enabling said person to manually control the movement of said applicator means with respect to said body or a portion thereof.

21. The device of claim 20 wherein said manual means enables said person to manually control the stimuli provided by said applicator means to said body or a portion thereof.

22. The device of claim 21 wherein said manual means comprises a remote control panel and a display and audio means responsive to said computer means.

23. The device of claim 22 wherein said computer means comprises a CRT display, wherein said remote control panel comprises an alpha-numeric display and an audio transducer, and wherein said display and audio means comprises said CRT tube, alpha-numeric display and transducer.

24. The device of claim 23 wherein said manual means comprises a joy stick controller.

25. The device of claim 24 wherein said joy stick controller is arranged to establish the position of said applicator means as a function of the orientation of said joy stick controller, and wherein said manual means additionally comprises switch means, whereupon when said switch means is operated, the position of said applicator means as defined by said joy stick control is entered into said computer means.

26. The device of claim 25 wherein said stimuli comprises pressure and said manual means additionally comprises a manual pressure establishing means to allow said person to manually control the amount of pressure applied to said body or a portion thereof, by said applicator means.

27. The device of claim 26 wherein said manual pressure establishing means comprises pressure control means for varying the amount of pressure applied to said body or a portion thereof, by said applicator means, and graph means for producing a graphic display of pressure responsive to said pressure control means produced by said computer means.

28. The device of claim 27 wherein said manual means additionally includes a direct pressure applying means for varying the pressure applied to said body or a portion thereof when said applicator means is in engagement therewith.

29. The device of claim 28 wherein said manual means additionally comprises timer means for setting a desired time period for operation of said device.

30. The device of claim 29 wherein said timer means comprises a timer control and a time display.

31. The device of claim 30 wherein said device additionally comprises prompt means to alert said person to the fact that said computer means wishes to communicate information to said person or that input is required from said person.

32. The device of claim 31 wherein said prompt means comprises a visual display and means for producing an audible signal.

33. The device of claim 21 wherein said manual means additionally comprises a manual reset means for stopping the movement of said applicator means and removing said applicator means from said body or a portion thereof.

34. The device of claim 33 wherein said manual reset means comprises a switch, which when operated sends a stop command signal to said computer means.

35. The device of claim 1 wherein said control means comprises computer means for controlling the location and movement of said applicator means in a transverse direction across said body or a portion thereof, and in a longitudinal direction along said body or a portion thereof.

36. The device of claim 35 wherein said device additionally comprises a first reversible motor for moving said applicator means in said transverse direction and a second reversible motor for moving said applicator means in said longitudinal direction, said first and said second reversible motors being responsive to, and controlled by, said computer means.

37. The device of claim 36 wherein said support means comprises a base rail positioned alongside and generally parallel to the longitudinal direction of said body, a carriage mounted for riding along said base rail and a vertical arm mounted on said carriage, said carriage being coupled, via gear means, to said first reversible motor and to said base rail so that when said first reversible motor rotates in a first direction said carriage and said vertical arm move on said rail in one longitudinal direction and when said first reversible motor rotates in a direction opposite to said first direction said carriage and said vertical arm move on said rail in a longitudinal direction opposite to said one longitudinal direction.

38. The device of claim 37 wherein said support means additionally comprises a cross arm mounted on said vertical arm, said applicator means being mounted on said cross arm.

39. The device of claim 38 wherein said cross arm is mounted on said vertical arm in a plane perpendicular to the plane of said base rail and said vertical arm, said applicator being coupled, via gear means, to said second reversible motor, whereupon when said second reversible motor rotates in a second direction said applicator means moves transversely across said body or a portion thereof, toward said vertical arm and when said second reversible motor rotates in a direction opposite to said second direction said applicator means moves transversely across said body or a portion thereof, away from said vertical arm.

40. The device of claim 36 wherein said computer means comprises a second slave microcontroller connected to, and responsive to, said master control processor, said second slave microcontroller controlling the the location and movement of said applicator means in the transverse direction across said body or a portion thereof.

41. The device of claim 40 wherein said second reversible motor comprises a shaft and wherein said device additionally comprises a second motor control unit and second motor feedback unit providing an input signal to said second motor control unit, said units being connected to and responsive to said second slave microcontroller, said device also comprising a second shaft rotation encoder mounted on said shaft of said second reversible motor and providing an input signal to said second motor feedback unit, and a second motor driver unit connected to said second reversible motor and receiving an input signal from said second motor control unit.

42. The device of claim 41 where said device additionally comprises a second limit switch for producing a second limit signal when said applicator means reaches a predetermined limit of transverse travel, said second limit signal being provided to said second microcontroller, said second motor unit, and said second motor driver to stop said second reversible motor and prevent said applicator from moving past said predetermined limit of transverse travel.

43. The device of claim 36 wherein said computer means comprises a master control processor and a first slave microcontroller connected to, and responsive to said master control processor, said first slave microcontroller controlling the location and movement of said applicator means in the longitudinal direction along said body or a portion thereof.

44. The device of claim 43 wherein said first reversible motor comprises a shaft and wherein aid device additionally comprises a first motor control unit and a first motor feedback unit providing input to said first motor control unit, said units being connected to and responsive to said first salve microcontroller, said device also comprising a first shaft rotation encoder mounted on said shaft of said first reversible motor and providing an input signal to said first motor feedback unit, and a first motor driver unit connected to said first reversible motor and receiving an input signal from said first motor control unit.

45. The device of claim 43 where said device additionally comprises a first limit switch for producing a first limit signal when said applicator means reaches a predetermined limit of longitudinal travel, said first limit signal being provided to said first microcontroller, said first motor control unit, and said first motor driver unit to stop said fist reversible motor and prevent said applicator means from moving past said predetermined limit.

46. The device of claim 45 wherein said computer means comprises a second salve microcontroller connected to, and responsive to, said master control processor, said second slave microcontroller controlling the the location and movement of said applicator means in the transverse direction across said body or a portion thereof.

47. The device of claim 46 wherein said second reversible motor comprises a shaft and wherein said device additionally comprises a second motor control unit and second motor feedback unit providing an input signal to said second motor control unit, said units being connected to and responsive to said second slave microcontroller, said device also comprising a second shaft rotation encoder mounted on said shaft of said second reversible motor and providing an input signal to said second motor feedback unit, and a second motor driver unit connected to said second reversible motor and receiving an input signal from said second motor control unit.

48. The device of claim 47 where said device additionally comprises a second limit switch for producing a second limit signal when said applicator means reaches a predetermined limit of transverse travel, said second limit signal being provided to said second microcontroller, said second motor unit, and said second motor driver to stop said second reversible motor and prevent said applicator from moving past said predetermined limit of transverse travel.

49. The device of claim 48 wherein said device additionally comprises a manual reset switch which when operated by said person produces a second signal which is connected to said first and second microcontroller, said first and second motor drive units, and said first and second motor control unit to stop said first and second reversible motors.

50. The device of claim 1 wherein said perimeter determining means comprises a means for positioning said applicator and switch means for entering information, representing the position of said applicator, into said control means.

51. The device of claim 50 wherein said positioning means comprises a joy stick and wherein said perimeter determining means further comprises a means for informing said control means that said position of said applicator represents the position of said perimeter of said body or a portion thereof.

52. The device of claim 1 wherein said device additionally comprises second means for preventing the movement of said applicator means beyond the perimeter of said body or a portion thereof.

53. The device of claim 52 wherein said second means is responsive to said first means.

54. The device of claim 1 wherein said one predetermined stimuli comprises pressure, and wherein said device additionally comprises pressure control means for automatically controlling the pressure applied to said body or a portion thereof, by said applicator means.

55. The device of claim 1 wherein wherein said control means comprises computer means for controlling the location and movement of said applicator means in a transverse direction across said body or a portion thereof, and in a longitudinal direction along said body or a portion thereof,.

56. A method for massaging said body or a portion thereof, of a person comprising the steps of:

(a) sensing the outer perimeter of a body or a portion thereof to generate a generating a program for a computer means to control the movement of an applicator means transversely across said body or a portion thereof, and longitudinally along the length of said body or a portion thereof, said transverse and said longitudinal movement being independent of each other;

(b) inserting said program into said computer means;

(c) connecting said computer means to said applicator means;

(d) placing said body or a portion thereof, on a platform beneath said applicator means;

(e) applying power to said computer means, whereupon said applicator means massages said body, or a portion thereof, as established by said program.

57. The method of claim 56 wherein said method additionally comprises the step of:

(a) adjusting the position of applicator means in response to said signal to said computer means to prevent said applicator means from moving outside the perimeter of said body or a portion thereof.

58. The method of claim 57 wherein said method additionally comprises the step of programming said computer means with the amount of pressure to be applied by said applicator to said body or a portion thereof, during said massage.

59. The method of claim 58 wherein said method additionally comprises the steps of:

(a) determining the pressure exerted by said applicator means on said body or a portion thereof, and providing a first signal indicative thereof;

(b) comparing said first signal to a signal representing desired amount of pressure to be applied and providing a second signal indicative thereof; and (c) adjusting the position of said applicator means in response to said second signal, whereupon the pressure applied by said applicator means is made equal to the desired amount of pressure.

60. The method of claim 59 wherein said method additionally includes the steps of:

(a) providing a manual control system to allow the user to insert applicator positioning and movement information;

(b) positioning and moving said applicator means transversely and longitudinally of said body or portion thereof with controls of said manual control system;

(c) generating electronic signals representing said positioning and movement;

(d) entering said signals into said computer means; and (e) programming said computer means to massage said body or a portion thereof, in response to said signals.

61. The method of claim 60 wherein said method additionally comprises the steps of:

(a) generating a manual reset signal with a manual reset switch and providing said reset signal to said computer means;

(b) programming said computer means to stop movement of said applicator means and to lift said applicator means off said body or a portion thereof, in response to said manual reset signal.

62. The method of claim 61 wherein said method additionally comprises the steps of:

(a) setting a desired pressure level for said massage with said controls;

(b) generating pressure level signal representing said desired pressure level; and (c) programming said computer means to move said applicator means to apply said desired pressure level to said body or a portion thereof, during said massage, in response to said pressure level signal.

63. The method of claim 62 wherein said method additionally comprises the steps of:

(a) setting a desired time period for said massage with said controls;

(b) generating a time period signal representing said desired time period; and (c) programming said computer means to massage said body or a portion thereof, for said desired time duration, in response to said time duration signal.

* * * * *